US006542176B1

(12) United States Patent
Camis

(10) Patent No.: US 6,542,176 B1
(45) **Date of Patent: *Apr. 1, 2003**

(54) ELECTRONIC DISPLAY DEVICES AND METHODS

(75) Inventor: Thomas Camis, Boise, ID (US)

(73) Assignee: Hewlett-Packard Development Co., L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/708,816

(22) Filed: Nov. 7, 2000

(51) Int. Cl.[7] ..... B41J 2/385; G03G 13/04; G03G 15/00; G03G 15/08

(52) U.S. Cl. ..... 347/139; 347/140; 399/108; 399/149; 399/158

(58) Field of Search ..... 347/139, 140; 399/158, 149, 108, 359, 168, 170, 174, 176, 148; 345/864, 169

(56) References Cited

U.S. PATENT DOCUMENTS

| | | | | | |
|---|---|---|---|---|---|
| 3,561,863 | A | * | 2/1971 | Brewster | 399/158 |
| 3,741,641 | A | * | 6/1973 | Gundlach et al. | 399/158 X |
| 4,136,943 | A | * | 1/1979 | Koizumi | 399/158 |
| 4,335,955 | A | * | 6/1982 | Lopata | 399/158 |
| 4,355,886 | A | * | 10/1982 | Perez et al. | |
| 4,760,410 | A | | 7/1988 | Kishi | |
| 4,896,190 | A | * | 1/1990 | Uchida et al. | 399/108 |
| 4,989,021 | A | * | 1/1991 | Ochiai et al. | |
| 4,998,141 | A | * | 3/1991 | Altmann | |
| 5,038,158 | A | * | 8/1991 | Ayers et al. | |
| 5,065,187 | A | * | 11/1991 | Itoh et al. | 399/158 X |
| 5,172,164 | A | * | 12/1992 | Fujiwara et al. | 399/158 X |
| 5,182,601 | A | * | 1/1993 | Hodoshima et al. | |
| 5,253,023 | A | * | 10/1993 | Hosaka et al. | 399/149 |
| 5,382,486 | A | * | 1/1995 | Yu et al. | |
| 5,424,811 | A | * | 6/1995 | Haneda | 347/140 |
| 5,842,081 | A | * | 11/1998 | Kaname et al. | 399/174 |
| 5,953,564 | A | * | 9/1999 | Matsuzoe et al. | 399/158 |
| 5,974,291 | A | * | 10/1999 | Yamaguchi | |

FOREIGN PATENT DOCUMENTS

| | | | |
|---|---|---|---|
| EP | 0456500 A2 | | 11/1991 |
| JP | 7-199723 | * | 8/1995 |

* cited by examiner

*Primary Examiner*—Susan S. Y. Lee

(57) ABSTRACT

Electronic display devices and methods are described. In one embodiment, a display device comprises a housing with a display area to display content for a user. Memory within the housing holds data that is to be rendered into user-viewable content. A loop of material is provided within the housing and is configured to display user-viewable content for the user. An exposure station is provided internally of the loop of material and is configured to expose selected portions of the loop of material so that the loop of material can receive and retain toner thereon to provide the user-viewable content from the data that is held in the memory. In another embodiment, a display device comprises a toner shuttling system within the housing that is configured to shuttle toner between different locations within the housing from which the toner can be used and reused. The shuttling system, in one implementation, takes the form of multiple toner reclamation/development stations, each of which being configured to operate to either reclaim toner or develop toner. The stations are desirably configured so that when one station operates to reclaim toner, another station operates to develop toner. In one particular implementation, the stations comprise a pair of switchably-biasable, bi-modal reclamation/development stations where, in one mode, a station develops toner and, in the other mode, the station reclaims used toner. Reclamation of toner can advantageously take place through non-invasive techniques, e.g. electrostatic techniques.

49 Claims, 7 Drawing Sheets

ELECTRONIC DISPLAY DEVICES AND METHODS

RELATED APPLICATIONS

This application is related to the following U.S. Patent Applications which are owned by the assignee of this document, and filed on the same date as this document, the disclosures of which are incorporated by reference herein:

- U.S. patent application Ser. No. 09/708,936, entitled "Solar Powered Electronic Display Devices and Methods", naming Tom Camis as inventor and bearing;
- U.S. patent application Ser. No. 09/708,362, entitled "Hand-held Electronic Display Devices and Methods", naming David Luman, Sam Johnson, and Tom Camis as inventors and bearing Attorney Docket No. 10003281-1;
- U.S. patent application Ser. No. 09/708,361, entitled "Toner Processing Systems and Electronic Display Devices and Methods", naming Tom Camis as inventor and bearing Attorney Docket No. 10003248-1;
- U.S. patent application Ser. No. 09/708,335, entitled "Electronic Display Devices and Methods", naming Sam Johnson as inventor and bearing Attorney Docket No. 10003249-1.

TECHNICAL FIELD

This invention pertains to display devices and, more particularly concerns display devices that are configured for use in serial, sequential reading applications.

BACKGROUND

Display devices come in many shapes and sizes and can be implemented using different types of technologies. One particular type of display device is one that enables a user to read various types of materials such as text (e.g. books, magazines, and newspapers) maps, drawings, and the like, while maintaining a desirable degree of portability. For example, in recent times, there has been a push by the industry to provide so-called electronic "readers" so that users might be able to read an electronic version of a favorite book or newspaper.

The design of electronic readers requires an appreciation and consideration of several factors that directly affect the popularity and commercial marketability of the electronic reader. In order to meet the demands of very discriminating consumers, and to provide an economically sensibly-manufactured product, electronic readers should or must: (1) be small enough to be conveniently portable, (2) have a desirable degree of contrast so that the user can easily read content that is displayed by the reader, (3) have a high degree of resolution so that the images displayed by the reader are crisp and clear, (4) have low power consumption characteristics to reduce the overall footprint within the device of the power supply component as well as to provide a desirably long lifetime for a given power supply, and (5) have a low enough cost so that it can be widely available for purchase by many consumers.

There are different technologies that are available for manufacturing various types of display devices among which include CRT (cathode ray tube) technologies, LCD (liquid crystal display) technologies, FEDs (field emission display) technologies, and so called "E-ink" technologies.

CRT technologies are limited, to a large extent, by the contrast that is able to be provided, the size requirements of the displays, the power consumption, resolution and cost. This technology is not a logical choice for conveniently portable electronic readers. LCD technologies typically have complicated electronics and display componentry and do not achieve a desired degree of resolution at a cost that is acceptable to compete in the display reader market. The same can be said of FED technologies.

There is a continuing unmet need for display readers that meet all or some of the criteria discussed above. It would be highly desirable to provide such a display reader that can display content from a number of various sources, such as the Web, a database, a server, and the like, and do so in a manner that satisfies or accommodates the needs of our biological system (i.e. eyes) for resolution, contrast, speed of image generation for reading and the like. Accordingly, the present invention arose out of concerns associated with meeting some or all of these needs.

SUMMARY

Electronic display devices and methods are described. In one embodiment, a display device comprises a housing with a display area to display content for a user. Memory within the housing holds data that is to be rendered into user-viewable content. A loop of material is provided within the housing and is configured to display user-viewable content for the user. The loop of material is provided as a photosensitive material, with an exemplary material comprising indium tin oxide. An exposure station is provided internally of the loop of material and is configured to expose selected portions of the loop of material so that the loop of material can receive and retain toner thereon to provide the user-viewable content from the data that is held in the memory.

In another embodiment, a display device comprises a toner shuttling system within the housing that is configured to shuttle toner between different locations within the housing from which the toner can be used and reused. The shuttling system, in one implementation, takes the form of multiple toner reclamation/development stations, each of which being configured to operate to either reclaim toner or develop toner. The stations are desirably configured so that when one station operates to reclaim toner, another station operates to develop toner. In one particular implementation, the stations comprise a pair of switchably-biasable, bi-modal reclamation/development stations where, in one mode, a station develops toner and, in the other mode, the station reclaims used toner. Reclamation of toner can advantageously take place through non-invasive techniques, e.g. electrostatic techniques.

In one methodical embodiment, a toner processing method comprises providing a loop of photosensitive material within a display device. The loop of photosensitive material is moved in a direction and charged to provide a charge distribution throughout portions of the loop of material. The loop of photosensitive material is exposed to light energy from an exposure station positioned internally of the loop sufficient to change the charge distribution throughout portions of the loop of photosensitive material. Responsive to the exposure, toner is developed onto the loop of photosensitive material to provide an image which is moved into a display area where it can be viewed. Toner that was developed onto the loop of photosensitive material to provide the image is then reclaimed for reuse. Reclamation of the toner can advantageously take place through non-invasive techniques, e.g. electrostatic techniques.

DETAILED DESCRIPTION

Exemplary Embodiment Overview

Figure 1:
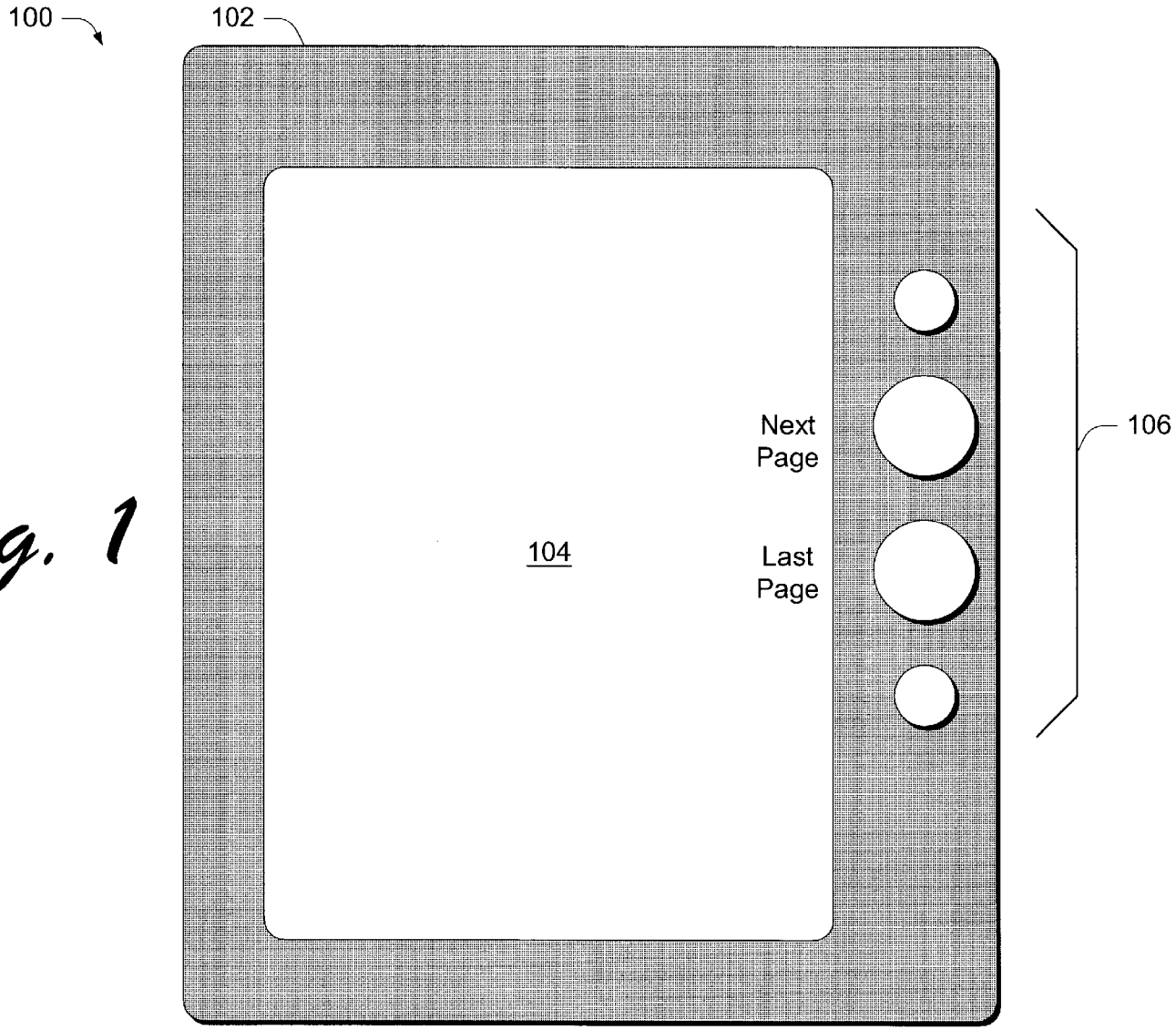
FIG. 1 is a front plan view of an exemplary electronic display device in accordance with the described embodiment.

FIG. 1 shows but one exemplary display reader embodiment generally at 100. Reader 100 comprises a housing 102 that can be formed from any suitable material and can assume any suitable size. In a preferred embodiment, reader 100 is sized to be conveniently portable by the user. Any suitable material can be used for the housing, with an exemplary housing material comprising a hard, durable lightweight plastic material. The housing 102 is configured to provide a display area 104 that is utilized to display content in the form of images that are presented to the user for viewing or reading. A control area 106 is provided and can include one or more user-engagable structures, e.g. buttons or other types of switch components, to permit the user to interact with the reader 100.

In a preferred embodiment, the reader 100 is configured as an electrophotographic printing device that utilizes known electrophotographic techniques to render an image within display area 104. These techniques are discussed in more detail below. The described reader 100 advantageously displays a non-volatile image within the display area 104 and retains the image until it is actively erased or removed. The image, as will become apparent below, does not need to be refreshed after it is rendered, as with other display technologies, so that power consumption, design complexity, and component complexity are desirably reduced. This constitutes a very desired improvement over the other display technologies.

In one particular embodiment, the display area 104 is sized so that it is around 6-inches by 9-inches in dimension, with the overall reader weighing less than about 2 pounds. This provides a viewing area that is generally larger than the viewing area in comparably sized displays that are available on the market. More importantly, the technology that is utilized to provide viewable images within the display area (i.e. electrophotographic technology) is capable of providing images in the range of 300–600 dots-per-inch (dpi) and better. This constitutes a noteworthy advancement over other display readers that provide images at around, or no better than 100 dpi. The higher dpi provided by the described embodiment translates to a higher-quality, clearer, more concise image for the user. Additionally, in one particular embodiment, the media that is utilized to support the image for the reader is selected so that it provides a book-like contrast (i.e. black print on a white page) to give the user an experience that is as close to reading a book as possible, as will become apparent below.

Exemplary Embodiment

Figure 2:
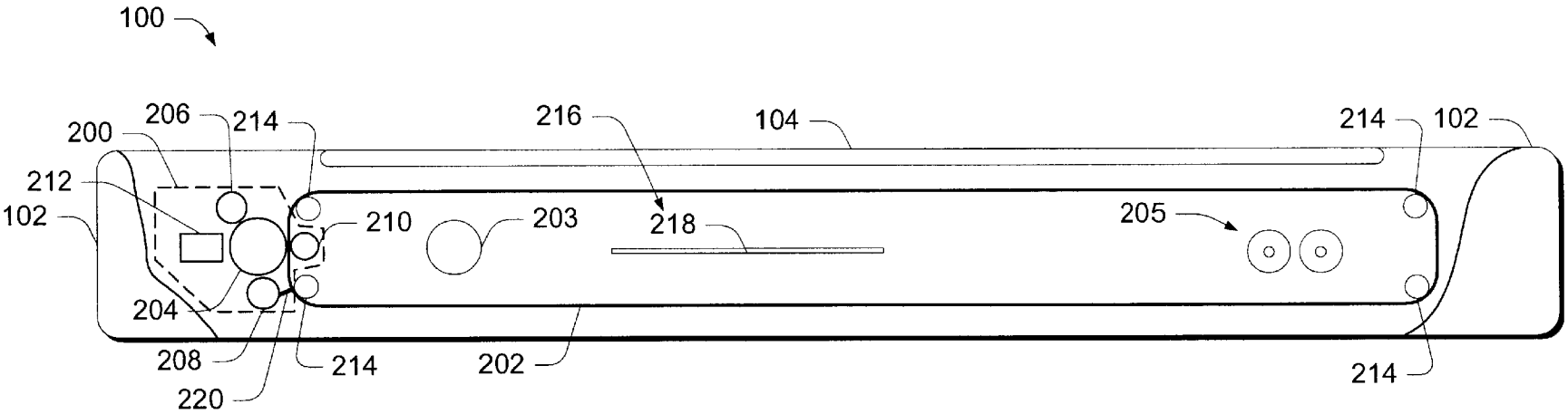
FIG. 2 is a side elevational view of the FIG. 1 device, with a portion removed to show detail.

FIG. 2 is a side view of the FIG. 1 reader with a portion broken away to show detail. In a preferred embodiment, the display reader is configured as an electrophotographic printing device that is similar in operation, in some respects, to a laser printer. Yet, the display reader differs from a laser printer in ways that serve to enhance its utility as a manufactured consumer product.

In the illustrated example, reader 100 includes image processing components that include an electrophotographic assembly 200, and a print media 202. A motor 203 in the form of a small DC permanent magnet motor is provided and, together with a gear train (not shown), cooperates to advance the print media 202 in a manner such that it can be viewed in the display area 104. The DC motor 203 is powered by a suitable power source 205 which, in this example, comprises a pair of standard AA batteries. It will be appreciated that other power sources could be used. One exemplary power source which can be used is a solar power source that can be used instead of, or in addition to the battery power source.

The electrophotographic assembly 200 can comprise any suitable electrophotographic assembly that is capable of providing non-volatile images onto the print media 202. In the described example, the assembly 200 comprises an optical photoconductor (OPC) 204 in the form of a rotatable drum that is similar in construction and operation to OPCs that are commonly employed in laser printers. A charge roller 206 and developer roller 208 are provided in operable proximity to the OPC 204. The developer roller is magnetic in nature and magnetically retains toner thereon, as will be appreciated by those of skill in the art. A transfer roller 210 is provided as shown and functions to transfer toner from the OPC to the print media in a conventional manner. A source of focused light energy is provided for exposing selected areas of the OPC. In this example, the source of light energy comprises a LED bar 212 that is configured as a 1-dimensional linear array scanning element. Other sources of focused light energy can, however, be utilized. For example, an optical scanning laser having rotatable polygons and beam modulators could be utilized. The reader will appreciate that any suitable toner that can be utilized in electrophotographic processes can be utilized in the presently-described embodiment. Preferably, the toner that is utilized has magnetic properties that permit its use in the described process, as will be understood by those of skill in the art.

Print media 202 is provided, in this example, as a continuous loop of material that is formed from a suitable dielectric material for purposes that will become evident. Exemplary materials are polyurethane and/or similar materials having the appropriate mechanical and electrical characteristics. The physical, electrical and optical characteristics of the toner-carrying loop of material are as follows. First, the loop of material has to function as toner transport system that also acts as the image viewing background. This requires mechanical integrity and strength so the loop of material will not stretch or tear, and is easy to track. In order to get adequate optical contrast between the black toner and the material loop there should also be a thin white (or light colored) over coating to provide this contrast. Therefore, the loop is constructed as an endless, two-layered structure. The uppermost layer is a relatively thin, smooth dielectric material (e.g. 0.00254 cm–0.00381 cm). This uppermost toner-supporting layer is preferred to be electrically non-conductive (e.g. volume resistivity>10^10 ohm-cm) and desirably has good surface charge retention characteristics to help retain toner on the surface. The underlayer is an elastomeric material that is electrically conductive (10^4 ohm-cm–10^7 ohm-cm) at a thickness of about (0.1 cm–0.15 cm).

The print media can have any suitable dimension that facilitates the portability of the overall reader. In one embodiment, the print media is dimensioned to be about 6-inches in width. This width gives the appearance of a page of a book.

In the illustrated example, print media 202 is supported by multiple idler rollers 214. Four exemplary idler rollers are used in this example. The idler rollers are spaced to accommodate an internal area 216 within which a printed circuit assembly 218, motor 204, power source 205 and a portion of the electrophotographic assembly are contained. The printed circuit assembly 218 contains the hardware and firmware that is utilized to implement the reader 100.

Exemplary Display Reader System

Figure 3:
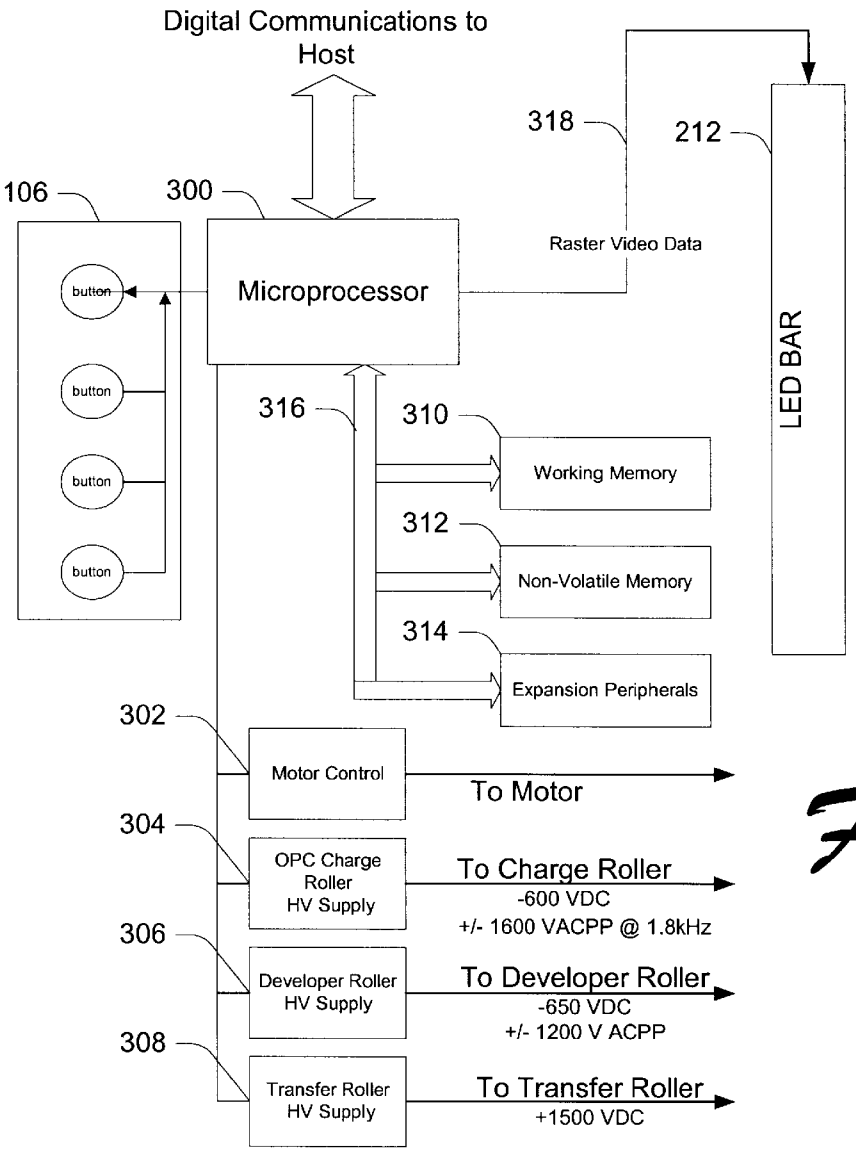
FIG. 3 is a diagram of an exemplary display device system.

FIG. 3 shows a diagram that includes various components of an exemplary display reader to assist in understanding how the described embodiment works. Some of these components are supported on the printed circuit assembly 218 (FIG. 2). The system uses, in a preferred embodiment, known rasterization techniques to render images for user viewing.

The illustrated and described display reader includes a microprocessor 300 that is operably coupled to a user interface that is provided within control area 106. The display reader also includes a motor control 302, OPC charge roller high voltage supply 304, developer roller high voltage supply 306 and transfer roller high voltage supply 308. The operation of these components are known and are not described in any more detail here. The display reader also includes working memory 310, non-volatile memory 312, expansion peripherals 314 and a bus 316 that operably connects these components to the microprocessor 300. The expansion peripherals component 314 is provided to accommodate additional peripherals that might be added to the unit (e.g. wireless modem/adapter, cell modem, CD ROM drive, and the like.

Working memory 310 can be any suitable memory such as RAM, SDRAM, and the like. This memory space is used to build pre-rasterized image maps which are computed prior to printing the next page. Additional rasterized pages, such as the current page, the next page, and previous few pages can be retained in the working memory 310 for fast retrieval and printing upon user demand. Firmware code can also be resident in a certain portion of this memory. The firmware code can be copied at power-up from a segment of non-volatile memory 312. This has advantages of downloading upgraded code for enhanced used features.

Nonvolatile memory 312 can be any suitable non-volatile memory such as Flash, Ferro-electric, battery backed EDO RAM, and the like. This memory is used to retain downloaded data content (such as books, magazines, newspapers, graphics, etc) that is to be rendered for view by the user. In this particular described implementation, roughly 1000 printed pages per megabyte of ASCII text can be stored with compression. Accordingly, 8 MB of memory would store about 8000 pages of text. This is the equivalent of dozens of novels, books, etc. The microprocessor operates on the ASCII/graphics data to rasterize it according to pre-built font maps, scalable font algorithms, bit-maps, etc., and creates a virtual image in DRAM. Using a low power microprocessor, this operation can take one or two seconds, thereby giving the user a virtually instant response to pushing a next page button. The data could also be pre-rasterized first. Thus, all that is required is to stream the video bit-map (compressed or uncompressed) to a Video Raster Data Line 318 which loads the LED array 212. Not shown in this illustration, but understood by those of skill in the art, is a strobe data line which latches the entire Video Raster Data Line into the LED buffer, causing the appropriate LED to fire.

The microprocessor 300 is configured to receive digital data or information from a host system. Content can be provided to the display reader through any suitable communication port/technique. For example, content can be downloaded from a user's host PC that is connected to the web. This content might be procured through some type of electronic business transaction whereby a user purchases content on line for later reading. In a preferred embodiment, data is downloaded using a USB (Universal Serial Bus). Other techniques or technologies can, of course, be used. Exemplary techniques include, without limitation, IR (Infrared), BlueTooth, RF (Radio Frequency), or any of a variety of other techniques that enable data to be received and/or provided by the display reader.

Soft Menu Item Feature

In one preferred embodiment, a so-called soft menu item feature is provided. Referring back to FIG. 1, the largest of the control buttons appearing in the control area 106 are seen to each be associated with a menu item that is presented within the display area. For example, the top most large control button is associated with a "Last Page" menu item and the bottom most large control button is associated with a "Next Page" menu item. These menu items are rendered directly onto the print media through the electrophotographic process and are aligned with the appropriate control buttons. Thus, with each new page, a set of soft menu items can be rendered and aligned with the control buttons. This is a feature that provides a desired degree of flexibility in that the soft menu items can be programmatically changed by changing the software that renders the menu items and controls their functionality.

In Operation

In operation, the described display reader provides a conveniently portable, handheld device that can be utilized to view content or text at the user's convenience. The content can be acquired by the device in any suitable manner. For example, as was mentioned above, a user might download content purchased from the Internet so that they can later view the content. The content, e.g. books and the like, would be saved in digital form in the memory of the display reader. The user, by manipulating the structures within control area 106 (e.g. next page, last page, zoom in, zoom out etc.), can then read or view the content that is resident on the display reader.

The images that are formed on the print media 202 are formed through the use of conventional rasterization techniques which will be understood by those of skill in the art. Accordingly, those techniques are not discussed in any detail here. However, for background information on suitable rasterization techniques, the reader is referred to the following U.S. Patents which are assigned to the assignee of this document, the disclosures of which are incorporated by reference herein: U.S. Pat. Nos. 6,037,962, 5,854,866, 5,490,237, 5,479,587, and 5,483,622.

In the illustrated and described embodiment, and with reference to FIG. 2, the print media 202 is advanced in a clockwise direction (as viewed in the figure) so that a user can view images that are developed onto the print media. The user can control the scrolling process as well as various display characteristics of the displayed image through the use of the buttons provided within the control area of the housing. The process of image formation is similar, in some respects, to the process by which an image is formed on a print media, e.g. paper, within a laser printer (including the rasterization techniques mentioned above). One noteworthy difference, however, is that the toner that is utilized in the presently-described embodiment is never fused onto the print media. Rather, the toner is held in place only by electrostatic forces which permit the toner to be reclaimed for further use.

More specifically, the optical photoconductor 204 is first charged by charge roller 206. Other techniques however, such as ion transport or a variety of other mechanisms can be used to charge the charge roller 206, as will be appreciated by those of skill in the art. Once the OPC 204 is charged, selected regions of the OPC are discharged by exposing the regions to focused light energy in a conventional manner. Exposure of the OPC takes place using the raster data that is provided by microprocessor 300 (FIG. 3). In the present example, LED bar 212 is utilized to discharge the selected areas of the OPC 204. This process forms an intermediary image on the OPC 204 that is to eventually appear on the print media 202. The intermediary image is then developed.

In the described embodiment, the development process involves the transport of toner particles (e.g. small electrostatically charged particles) into close proximity with the OPC's intermediary image or latent image. The intent of the development process is to allow the toner particles to be attracted to the discharged portions of the OPC 204. There are a variety of development technologies that can be utilized to effect the development process, as will be apparent to those of skill in the art. For example, so called discharge-area-development "DAD" "jump-gap" technology can be utilized. This technology transfers toner by bringing it into close proximity to, but not into direct contact with the OPC 204. An AC and DC electrical bias arrangement is then used to "project" the toner particles over the physical distance between the developer roller 208 and the OPC 204. Alternately, so-called "contact" technologies can be used to develop the image on the OPC 204. In contact technologies, the toner particles are brought into direct physical contact with the OPC 204 where transfer is accomplished similarly, as will be appreciated by those of skill in the art. Various suitable toner development technologies are discussed in the following U.S. Patents, assigned to the assignee of this document, the disclosures of which are incorporated by reference: U.S. Pat. Nos. 5,991,589 and 5,799,230.

Once the toner has been developed onto the OPC, the image on the OPC is transferred to the print media 202. In the described embodiment, this is effectuated through the use of transfer roller 210 that is positioned on the backside of the print media. The transfer roller attracts the toner off of the OPC 204 and onto the print media in a conventional electrostatic manner. As the print media advances in the clockwise direction, the images that it supports (such as text) can be viewed by the user. The user can view and manipulate these images by manipulating the engagable structures within the control area 106. As the print media advances, the above-described process is repeated for serially presenting content such as the text that one might find on the pages of a book or magazine.

Toner Reclaim

As the media-carried toner returns to the electrophotographic assembly 200, the toner that resides on the media is reclaimed for additional use. In the presently-illustrated example, a wiper blade mechanism 220 is provided and physically engages the print media as the media passes. The wiper blade mechanism can be constructed from any suitable material, with an exemplary material comprising silicone. The toner can also be re-claimed through electrostatic techniques that are described in U.S. patent application Ser. No. 09/708,361, entitled "Toner Processing Systems and Electronic Display Devices and Methods", naming Tom Camis as inventor, the disclosure of which is incorporated by reference above. The toner is then re-attracted to the developer roller 208 by virtue of its reversed electrostatic field forces that are provided by the DC and AC electrical biasing in a manner that will be appreciated by those of skill in the art. The OPC development process and image formation process described above can then be repeated.

Toner

In the illustrated and described embodiment, any suitable toner that is typically used in conventional electrophotographic applications can be utilized. In some implementations, it would be particularly advantageous to utilize a toner that is spherical in nature with the toner particles having a diameter in the range of 15–20 microns. Such toner should be "hard" as contrasted with the typically "soft" fusible toner that is utilized in electrophotographic fusing operations. By using a hard toner with particles dimensioned as described, developing voltages and power requirements can be reduced. Additionally, a hard spherical toner would be advantageous in that it would be robust and resist degradation during toner reclaim operations.

Exemplary Method

Figure 4:
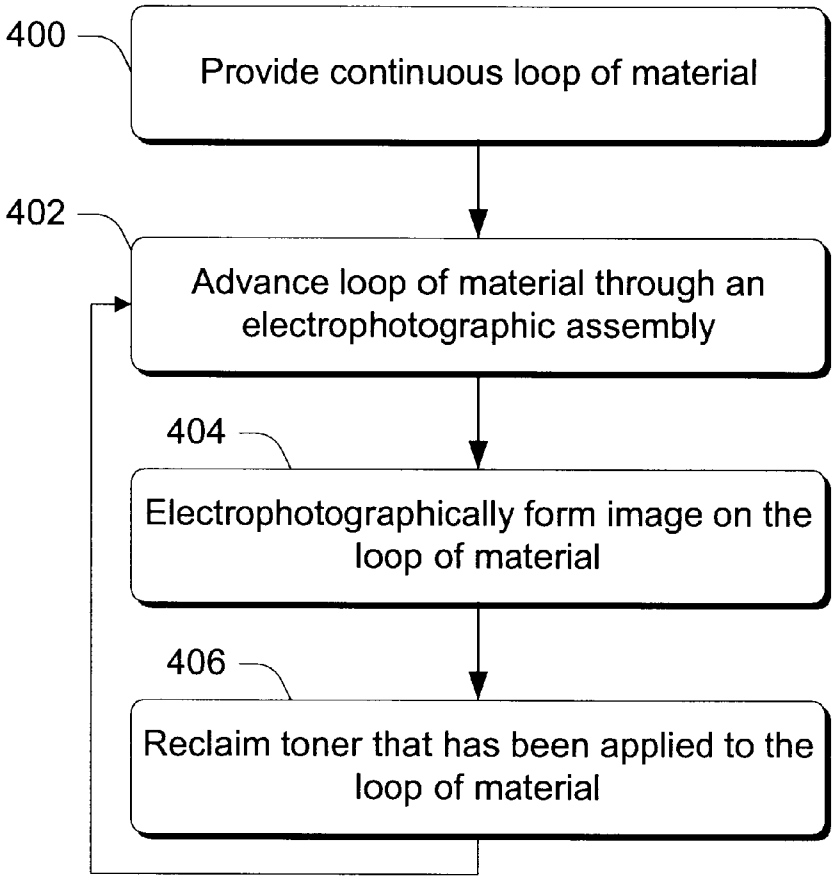
FIG. 4 is a flow diagram that describes steps in a method in accordance with the described embodiment.

FIG. 4 is a flow diagram that describes steps in a method in accordance with the described embodiment. The steps described below can be implemented using a reader device such as the one that is described above.

Step 400 provides a continuous loop of material upon which an image is to be formed. Exemplary materials are described above. Step 402 advances the loop of material through an electrophotographic assembly that is configured to electrophotographically form an image on the loop of material. Step 404 electrophotographically forms an image on the loop of material by applying non-fused toner to the loop of material. The image is then advanced into a display area so that the user can view the image. Step 406 reclaims toner that has been applied to the loop of material and returns to step 402 to reuse toner that has been previously reclaimed.

The embodiments described above are different from other approaches that have been attempted in the past. These differences accentuate the advantages that the presently-described embodiment provides.

First, the described approach is different from the approaches that are typically taken by a laser printer in that the toner is not fused to the print media. This reduces the complexity and cost of the design because fusing components are not necessary. Additionally, because the toner is not permanently applied to the print media, it can be reclaimed for use. This can add to the useful life of the device.

Additionally, the inventors are not aware of any portable reader devices that utilize a continuous loop of material as the print media. The continuous nature of the loop of material is advantageous because it can be reused over and over again, thus effectively increasing the lifetime of the reader. The reader construction is thus essentially self-contained and does not have to have any of the components replaced for further operation.

Further, the use of OPC 204 in combination with the preferred print media is advantageous in that it does not require the use of harmful or volatile materials and provides a reusable material with a book-like contrast quality. For example, there are print devices that utilize a print media that is coated with cadmium sulfide which is a toxic material. In addition to its toxicity, cadmium sulfide is not a desirable material to use because it is yellow in color and does not provide a desirable degree of contrast when viewed.

Internal Exposure and Multiple Developer Shuttle System and Embodiments

In one embodiment, exposure of the loop of material takes place internally of the loop of material. This provides for a more compact device "footprint". In another embodiment, a toner "shuttle" system is provided which enables toner to be conveniently reused and shuttled between multiple stations within the device.

Figure 5:
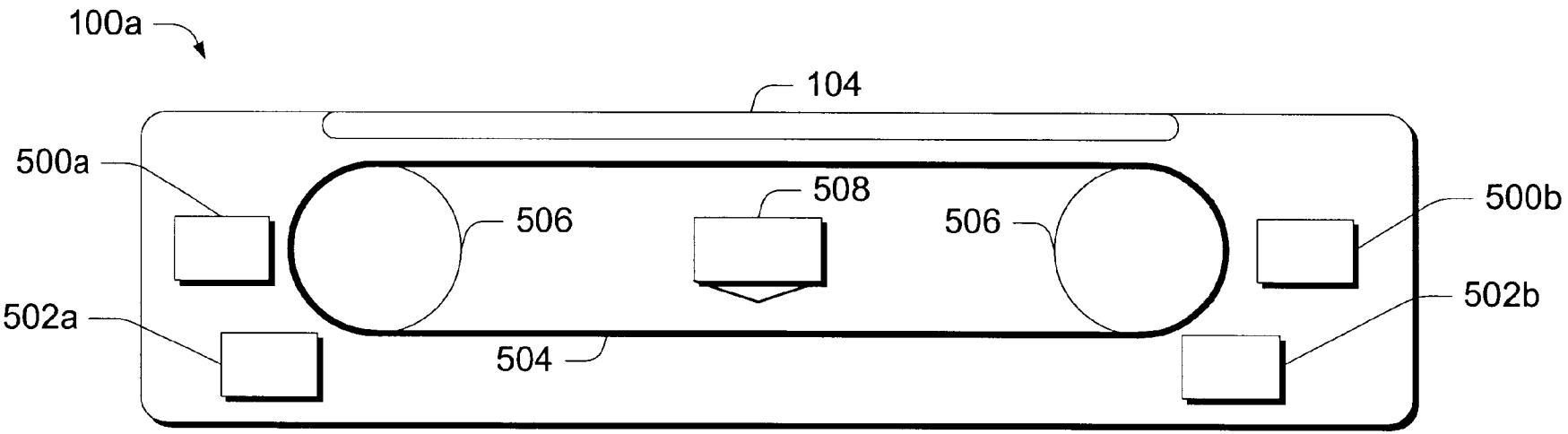
FIG. 5 is a side elevational view of an exemplary display device in accordance with another embodiment.

FIG. 5 shows but one example which combines both of these features. It is to be understood, however, that the features are not necessarily dependent on one another and could be separately implemented. Like numerals from the FIG. 2 embodiment are utilized where appropriate, with differences being indicated by the suffix "a" or with different numerals.

Display reader 100*a* comprises multiple toner reclamation/development stations which serve to allow reusable toner to be shuttled between multiple different stations and hence, reused in a convenient manner. In the illustrated and described embodiment two such stations are provided at 500*a*, 500*b*. Each individual toner reclamation/development station is desirably configured to perform two separate functions. First, the station is configured so that it can develop toner onto a substrate, such as the loop of material 504 which is discussed in more detail below. Second, the station is configured so that it can remove or recover toner that has been developed onto the substrate. This imparts a dual purpose to each of the illustrated stations which enhances the lifetime of the device. Separate charging stations 502*a*, 502*b* are provided and serve to charge the loop of material 504 as will become apparent below.

The loop of material 504, in this particular example, comprises a photosensitive material, with an exemplary and preferred material comprising indium tin oxide (ITO). The loop of material acts as a ground plane upon which the toner particles are attracted. Any suitably dimensioned material can be used. An exemplary ITO material can be on the order of 100 to 200 Angstrom in thickness. Preferably the ITO material has a reflective coating of material on the outer surface to prevent exposure from external ambient or ultraviolet light. Such coating also provides a desirable optical contrast with the toner particles, enhanced strength and support. The loop of material 504 is supported by two exemplary idler rollers 506 which, in this example, are grounded.

An exposure station 508 is provided, in this example, internally of the loop of material 504. The exposure station can, however, be provided outside of the loop of material. By locating the exposure station internally of the loop of material, the overall device footprint can be reduced. The exposure station provides a source of light energy for exposing selected portions of material loop 504. The exposed portions are later to receive and temporarily retain toner thereon. Any suitable exposure station can be utilized. In the present example, the exposure station comprises a LED bar.

Figure 6:
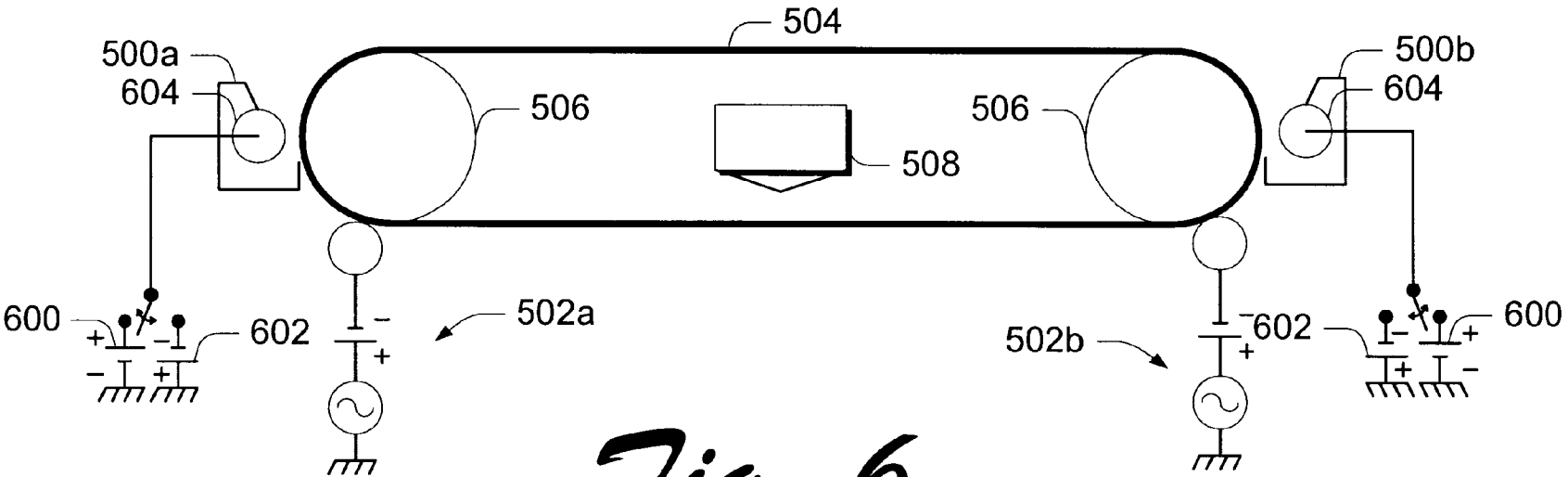
FIG. 6 is a side elevational view of an exemplary implementation of the FIG. 5 device.

FIG. 6 shows selected exemplary components of the FIG. 5 system in somewhat more detail. Each reclamation/development station 500*a*, 500*b* comprises, in this example, a pair of voltage sources 600, 602 and a roller mechanism 604 coupled with the voltage sources to be switchably biased by the voltage sources by virtue of a switching mechanism (not specifically designated). In one mode the roller mechanism 604 is biased in a certain manner such that toner development occurs. In another mode, the roller mechanism 604 is biased oppositely so that toner reclamation or recovery occurs. In one mode of operation, station 500*a* develops toner onto the loop of material until the toner supply is exhausted or reaches a predetermined level, while station 500*b* recovers toner that has been developed onto the loop of material by station 500*a*. The operation as between the stations then switches, with station 500*b* developing toner onto the loop of material and station 500*a* recovering toner from the loop of material. Switching between the development and recovery modes is effectuated by reversing the bias that is applied to the respective roller mechanisms 604.

In addition, charging stations 502*a*, 502*b* are shown to include an AC voltage source, a DC voltage source (neither of which being specifically labeled), and a charge roller. The charging stations work in a manner that will be understood by those of skill in the art.

In operation, the described embodiment provides a toner shuttling mechanism that moves unfused, recoverable toner from one reclamation/development station to another. In the particular example of FIGS. 5 and 6, assume that the loop of material 504 is moved in a counterclockwise direction. Assume also that initially, all of the toner resides at station 500*b*, and station 500*a* is used as the reclamation or recovery station. Assume also that at this point, no toner has been applied to the material loop 504. Material loop 504 is first negatively charged by charging station 502*a*. As the material loop is cycled, selected regions thereof are then exposed at exposure station 508. By being photosensitive, once electrostatic charge is placed on the material loop, if exposed properly, the charge effect in the exposed areas can be diminished. As the material loop continues through the cycle, the light-exposed portion passes station 500*b* where, recall, the toner resides. The developer roller 604 at station 500*b* is biased in such a way that it is also negative. This serves to force the toner off of the roller and onto the exposed regions of the material loop 504, thereby forming an image on the material loop. Those regions of the material loop that were not exposed do not retain toner as they are negatively charged—the same as the toner. As the material loop continues to cycle, the formed images can be viewed through the display area 104 (FIG. 5). When the material loop advances past station 500*a*, the developer roller 604 is biased in such a way that the toner is attracted off of the material loop 504. In this example, the developer roller 604 at station 500*a* would be positively biased to attract the negatively charged toner off of the material loop 504.

When the supply of toner at station 500*b* has reached a predetermined low level, the roles of the stations can be reversed. Specifically, assume now that station 500*a* has collected all of the toner from station 500*b*. The direction of material loop 504 can be changed so that it now moves in the clockwise direction. Charging of the material loop takes place at charging station 502*b* and exposure at exposure station 508. The toner from station 500*a* is then developed onto the material loop as the loop passes the station by changing the bias that is applied to roller 604. The material loop is then advanced into the display area for user viewing. As the loop advances past the display area, it is reclaimed at station 500*b* as described above with respect to station 500*a*. Accordingly, the toner is "shuffled" back and forth between the different stations.

Advantages of the above described system include providing a reader display with a smaller thickness footprint because the exposure components are located internally of the material loop. Additionally, faster speeds can be attained because of the distance between the exposure station and the developer station.

Figure 7:
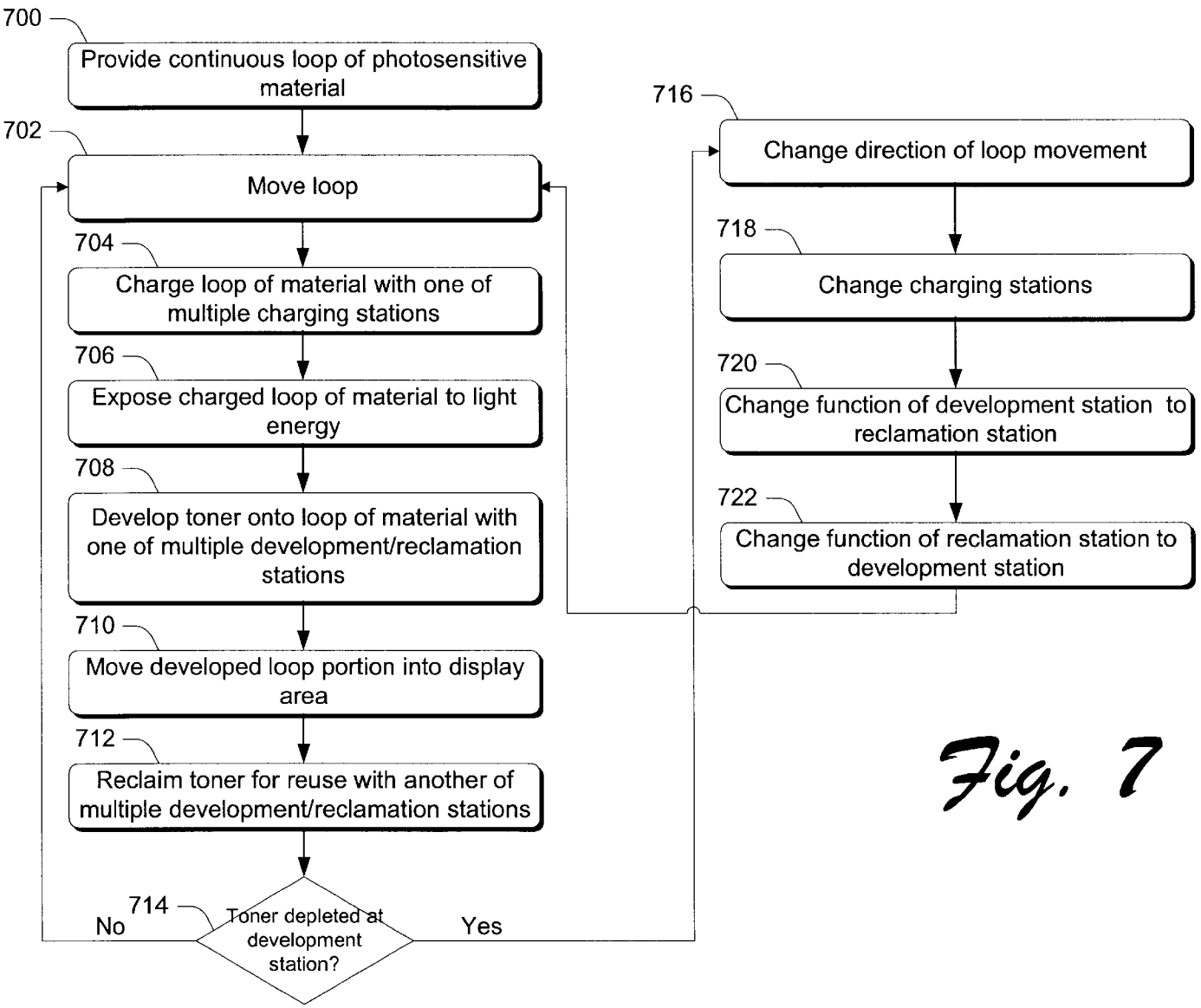
FIG. 7 is a flow diagram that describes steps in a method in accordance with one embodiment.

FIG. 7 is a flow diagram that describes steps in a method in accordance with the above-described embodiment. The method can be implemented in connection with a display reader system, such as the one described in connection with FIGS. 5 and 6. Step 700 provides a continuous loop of photosensitive material. An exemplary material is indium tin oxide which is discussed above. Other suitable photosensitive materials can, of course, be utilized. Step 702 moves the loop of material. In the illustrated example of FIGS. 5 and 6, the loop of material can either be moved in the clockwise or counterclockwise direction, depending on how the reclamation/development stations are configured. Step 704 charges the loop of material with one of multiple charging stations. Step 706 exposes the loop of material to light energy which changes the charge distribution throughout the material loop. Step 708 develops toner onto the loop of material with one of multiple development/reclamation stations. Step 710 moves the developed loop portion into a display area so that a user can view the image that is provided on the material loop. Step 712 then reclaims the toner for reuse with another of multiple development/reclamation stations. Step 714 determines whether the toner at the development station is depleted or otherwise at a predetermined level of depletion. If the toner is not depleted, then step 714 returns to step 702 and continues processing using the first stated development/reclamation stations as originally configured. If, however, the toner is sufficiently depleted, then step 716 changes the direction of movement of the loop of material. Step 718 changes charging stations, step 720 changes the function of the previously-stated development station to that of a reclamation station, while step 722 changes the function of the previously-stated reclamation station to that of a development station. One particular way of implementing this operation is described above. The method then returns to step 702.

Conclusion

The various embodiments described above provide a low cost display device that is sized so that it is conveniently portable. A desirable degree of contrast is provided through the use of an electrophotographic image-forming process that utilizes a print media in the form of a loop of material that is selected so that it provides a black/white contrast when used in connection with black toner. Resolutions can be attained that are at least 300 dpi and better, thereby providing the user with a book-like experience when the device is used to read text. The device has low power consumption characteristics owing at least in part to the electrophotographic process that is utilized to provide the viewable images. The device is only required to consume power when a new image is being rendered and advanced into the device's viewing area. Consequently, the equivalent of many novels can be read by a user without having to replace the power source.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. An electronic display device comprising:

a housing;

a display area provided within the housing to display content for a user;

memory within the housing to hold data that is to be rendered into user-viewable content;

a loop of material within the housing and configured to display user-viewable content for a user; and an exposure station internally of the loop of material and configured to expose selected portions of the loop of material so that the loop of material can receive and retain toner thereon to provide the user-viewable content from the data that is held in the memory;

the display device having a size and weight that makes the device conveniently portable for the user, the display device further being configured to permit operation while the device is being carried by a user.

2. The electronic display device of claim 1, wherein the loop of material comprises a photosensitive material.

3. The electronic display device of claim 2, wherein the photosensitive material comprises indium tin oxide.

4. The electronic display device of claim 2, wherein the photosensitive material comprises a ground plane material.

5. The electronic display device of claim 1, wherein the exposure station comprises an LED bar.

6. The electronic display device of claim 1, wherein the device is portable.

7. The electronic display device of claim 1, wherein the device is battery operated.

8. An electronic display device comprising:

a housing;

a display area provided within the housing to display content for a user;

memory within the housing to hold data that is to be rendered into user-viewable content;

a print media within the housing and configured to display, with toner, user-viewable content for a user; and a toner shuttling system fixed in position within the housing and configured, in its fixed position within the housing, to shuttle toner between different locations within the housing from which the toner can be used and reused;

the display device having a size and weight that makes the device conveniently portable for the user.

9. The electronic display device of claim 8, wherein the toner shuttling system comprises multiple toner reclamation/development stations each of which being configured to operate to either reclaim toner or develop toner.

10. The electronic display device of claim 9, wherein the multiple toner reclamation/development stations comprise two such stations.

11. The electronic display device of claim 9, wherein the multiple toner reclamation/development stations comprise two such stations, the stations being configured so that when one station operates to reclaim toner, the other station operates to develop toner.

12. The electronic display device of claim 8 further comprising multiple charging stations to charge the print media.

13. The electronic display device of claim 8, wherein the print media comprises a loop of material.

14. The electronic display device of claim 13, wherein the loop of material comprises a photosensitive material.

15. The electronic display device of claim 14, wherein the photosensitive material comprises indium tin oxide.

16. The electronic display device of claim 13, wherein the loop of material comprises a ground plane material.

17. The electronic display device of claim 13 further comprising an exposure station within the housing positioned to expose the loop of material so that toner can be applied and retained thereon.

18. The electronic display device of claim 17, wherein the exposure station is located externally of the loop of material.

19. The electronic display device of claim 17, wherein the exposure station is located internally of the loop of material.

20. An electronic display device comprising:

a housing;

a display area provided within the housing to display content for a user;

memory within the housing to hold data that is to be rendered into user-viewable content;

a loop of material within the housing and configured to display user-viewable content for a user; and a pair of switchably-biasable, bi-modal reclamation/development stations within the housing, each of which being configured to develop toner onto the loop of material in one mode, and reclaim toner from the loop of material in another mode.

21. The electronic display device of claim 20, wherein each reclamation/development station comprises a biasable roller.

22. The electronic display device of claim 20, wherein, when operational, each reclamation/development station is configured to operate in a mode that is different from a mode in which the other of the reclamation/development stations operates.

23. The electronic display device of claim 20, wherein the loop of material comprises a photosensitive material.

24. The electronic display device of claim 20 further comprising an exposure station within the housing positioned to expose the loop of material so that toner can be applied and retained thereon.

25. The electronic display device of claim 24, wherein the exposure station is located externally of the loop of material.

26. The electronic display device of claim 24, wherein the exposure station is located internally of the loop of material.

27. An electronic display device comprising:

a housing;

a display area provided within the housing to display content for a user;

memory within the housing to hold data that is to be rendered into user-viewable content;

a loop of material within the housing and configured to display user-viewable content for a user;

multiple toner development stations within the housing to develop toner onto the loop of material; and multiple electrostatic toner recovery stations configured to non-invasively recover toner from the loop of material;

the toner development stations and the toner recovery stations being fixedly mounted in fixed positions within the housing and being configured to collectively, in their respective fixed positions, shuttle toner back and forth between different locations within the housing;

the display device having a size and weight that makes the device conveniently portable for the user.

28. The electronic display device of claim 27, wherein the loop of material comprises a photosensitive material.

29. The electronic display device of claim 28, wherein the photosensitive material comprises indium tin oxide.

30. The electronic display device of claim 27, wherein individual toner development stations are integrated with individual electrostatic toner recovery stations to provide multiple stations each of which can develop and recover toner.

31. A method of displaying images comprising:

providing an amount of photosensitive material within a display device having a size and weight that makes the device conveniently portable for a user;

charging the photosensitive material to provide a charge distribution throughout portions of the material;

exposing the photosensitive material to light energy from an exposure station, said exposing changing the charge distribution throughout said portions of the photosensitive material;

developing toner onto the photosensitive material to provide an image thereon; and reclaiming toner that was developed onto the photosensitive material, said display device being configured to permit said acts of charging, exposing, developing and reclaiming to be performed while the display device is being carried by the user.

32. The method of claim 31 further comprising reusing reclaimed toner to provide additional images on the photosensitive material.

33. The method of claim 31, wherein said charging is accomplished using one of multiple charging stations within the display device.

34. The method of claim 31, wherein said reclaiming comprises non-invasively reclaiming the toner.

35. The method of claim 34, wherein said reclaiming comprises electrostatically reclaiming the toner.

36. The method of claim 31, wherein said developing and reclaiming are performed by different stations within the display device, each station being configured to both develop and reclaim toner.

37. The method of claim 36, wherein said stations each comprise a roller that is switchably biasable to function either to develop or reclaim toner.

38. A method of displaying images comprising:

moving a loop of material in a first direction within a portable electronic display device, the device having a size and weight that makes the device conveniently portable for a user;

charging the loop of material with a first of two charging stations;

exposing the loop of material to light energy sufficient to change a charge distribution within the loop of material;

developing toner onto the loop of material after said exposing to provide an image, said developing taking place at a first toner-processing station that is configured to both develop toner onto the loop of material and reclaim used toner from the loop of material;

moving the image into a display area of the display device; and reclaiming toner that has been developed onto the loop of material using a second toner-processing station that is configured to both develop toner onto the loop of material and reclaim user toner from the loop of material;

determining whether toner at the first toner-processing station is sufficiently depleted and, if so, changing functions between the first and second toner-processing stations; and moving the loop of material in a second direction that is different from the first direction in connection with changing said functions.

39. The method of claim 38 further comprising charging the loop of material with the other of the two charging stations in connection with changing said functions.

40. The method of claim 38, wherein said exposing comprises exposing the loop of material with an exposure station that is positioned internally of the loop of material.

41. The method of claim 38, wherein the loop of material comprises photosensitive material.

42. The method of claim 38, wherein the loop of material comprises indium tin oxide.

43. A method of displaying images comprising:

providing an amount of photosensitive material within a display device, the device having a size and weight that makes the device conveniently portable for a user;

charging the photosensitive material to provide a charge distribution throughout portions of the material;

exposing the photosensitive material to light energy from an exposure station, said exposing changing the charge distribution throughout said portions of the photosensitive material;

developing toner onto the photosensitive material to provide an image thereon; and reclaiming toner that was developed onto the photosensitive material, wherein said developing and reclaiming are performed by different stations within the display device, each station being configured to both develop and reclaim toner from fixed positions within the display device in a manner which shuttles toner back and forth between different locations within the display device.

44. The method of claim 43, wherein said stations each comprise a roller that is switchably biasable to function either to develop or reclaim toner.

45. A method of displaying images comprising:

moving a loop of material in a first direction within a portable electronic display device;

charging the loop of material with a first of two charging stations;

exposing the loop of material to light energy sufficient to change a charge distribution within the loop of material;

developing toner onto the loop of material after said exposing to provide an image, said developing taking place at a first toner-processing station that is configured to both develop toner onto the loop of material and reclaim used toner from the loop of material;

moving the image into a display area of the display device;

reclaiming toner that has been developed onto the loop of material using a second toner-processing station that is configured to both develop toner onto the loop of material and reclaim user toner from the loop of material;

determining whether toner at the first toner-processing station is sufficiently depleted and, if so, changing functions between the first and second toner-processing stations; and moving the loop of material in a second direction that is different from the first direction in connection with changing said functions.

46. The method of claim 45 further comprising charging the loop of material with the other of the two charging stations in connection with changing said functions.

47. The method of claim 45, wherein said exposing comprises exposing the loop of material with an exposure station that is positioned internally of the loop of material.

48. The method of claim 45, wherein the loop of material comprises photosensitive material.

49. The method of claim 45, wherein the loop of material comprises indium tin oxide.

* * * * *